US010480847B2

(12) United States Patent
Heisswolf et al.

(10) Patent No.: US 10,480,847 B2
(45) Date of Patent: Nov. 19, 2019

(54) DOMESTIC APPLIANCE WITH AN APPLIANCE COMPONENT HAVING A HANDLE RECESS ACCESSIBLE FROM ABOVE

(71) Applicant: BSH HAUSGERAETE GMBH, Munich (DE)

(72) Inventors: Tobias Heisswolf, Syrgenstein (DE); Simon Kraemer, Aalen (DE); Alfred Raab, Huettlingen (DE); Christian Schmid, Neu-Ulm (DE); Ralph Staud, Munich (DE); Thomas Tischer, Haar (DE); Philipp Kleinlein, Munich (DE); Andreas Kessler, Munich (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/774,609

(22) PCT Filed: Oct. 26, 2016

(86) PCT No.: PCT/EP2016/075835

§ 371 (c)(1),
(2) Date: May 9, 2018

(87) PCT Pub. No.: WO2017/084845

PCT Pub. Date: May 26, 2017

(65) Prior Publication Data

US 2018/0320953 A1 Nov. 8, 2018

(30) Foreign Application Priority Data

Nov. 18, 2015 (DE) ..... 10 2015 222 732

(51) Int. Cl.
*F25D 23/02* (2006.01)

(52) U.S. Cl.
CPC ..... *F25D 23/028* (2013.01); *F25D 23/02* (2013.01); *F25D 2400/36* (2013.01)

(58) Field of Classification Search
CPC ..... F25D 23/02; F25D 23/028; F25D 25/025; F25D 29/005; F25D 2323/02; F25D 2400/36; F25D 2400/361
See application file for complete search history.

(56) References Cited

U.S. PATENT DOCUMENTS 250,371 A 12/1881 Liemke
8,328,301 B2 † 12/2012 Lee
(Continued)

FOREIGN PATENT DOCUMENTS

CN 104279820 A 1/2015
DE 102009026659 A1 * 12/2010 ..... A47L 15/4257
(Continued)

OTHER PUBLICATIONS

CN104279820 Translation, 7 pages (Year: 2015).*
DE102011005893 Translation, 9 pages (Year: 2012).*

*Primary Examiner* — Andrew M Roersma
(74) *Attorney, Agent, or Firm* — Laurence A. Greenberg; Werner H. Stemer; Ralph E. Locher

(57) ABSTRACT

A domestic appliance includes a housing and an appliance component which is disposed on the housing, is separate from the housing and is movable relative to the housing. A handle which is disposed on the appliance component has a handle recess which can be gripped from above and which is delimited by a front wall of the handle and a slanted bottom wall of the handle.

22 Claims, 6 Drawing Sheets

(56) References Cited

U.S. PATENT DOCUMENTS

| | | | | |
|---|---|---|---|---|
| 10,018,218 | B2 † | 7/2018 | Jung | |
| 2003/0168080 | A1 | 9/2003 | Raches | |
| 2006/0158071 | A1 | 7/2006 | Muller et al. | |
| 2009/0326957 | A1 * | 12/2009 | Yang | F25D 29/00 704/275 |
| 2010/0320890 | A1 | 12/2010 | Jung et al. | |
| 2011/0006655 | A1 | 1/2011 | Seo et al. | |
| 2012/0092139 | A1 * | 4/2012 | Ehrensberger | F24C 7/082 340/12.23 |
| 2012/0104909 | A1 * | 5/2012 | Kaplan | F25D 23/02 312/204 |

FOREIGN PATENT DOCUMENTS

| | | | | | |
|---|---|---|---|---|---|
| DE | 102011005893 | A1 | | 9/2012 | |
| DE | 102011007318 | A1 | * | 10/2012 | F25D 23/028 |
| JP | S4831584 | Y1 | | 9/1973 | |
| JP | S6060686 | U | | 4/1985 | |
| KR | 20090087146 | A | | 8/2009 | |
| KR | 1020090087146 | A | * | 8/2009 | F25D 29/00 |
| WO | WO-2013126946 | A1 | * | 9/2013 | A47B 95/02 |
| WO | 2015015355 | A1 | | 2/2015 | |

* cited by examiner
† cited by third party

DOMESTIC APPLIANCE WITH AN APPLIANCE COMPONENT HAVING A HANDLE RECESS ACCESSIBLE FROM ABOVE

BACKGROUND OF THE INVENTION

Field of the Invention

The invention relates to a domestic appliance comprising a housing and an appliance component which is arranged on the housing and is separate from the housing and is movable relative to the housing. Furthermore, the domestic appliance comprises a handle which is arranged on the appliance component.

In this context a domestic refrigerator is known from US 2011/0006655 A1. This has a drawer which comprises a front wall. A curved handle is arranged on an exterior of the front wall. The handle is embodied separately and compared with the front side or the exterior of the front wall of this drawer extends in a raised manner forward so that it can be gripped. This curved handle bar is furthermore arranged at a distance from a display unit integrated in an upper region in the front wall.

With known handles of this type, an undesirable, projecting part exists and the handle is restricted in terms of its functionality.

SUMMARY OF THE INVENTION

The object of the present invention is to create a domestic appliance, in which a more compact design can be achieved with a handle arranged on an appliance component and an improved functionality can still be achieved.

The object is achieved by a domestic appliance which comprises a housing. Furthermore, the domestic appliance comprises an appliance component which is arranged on the housing and is embodied separate from the housing. The appliance component is arranged thereupon so as to be movable relative to the housing. Furthermore, the domestic appliance comprises a handle which is arranged on the appliance component. One essential idea behind the invention is that the handle has a handle recess which can be gripped from above and which is delimited by a front wall of the handle and a slanted bottom wall of the handle. As a result, a specifically molded handle is formed, by means of which the installation space in the depth direction of the appliance component can be reduced. Furthermore, engagement from above is more user-friendly for ergonomic reasons. Lastly, an additional functionality can also be associated with the handle on account of this specifically designed handle recess, which is delimited by walls arranged and oriented in a wholly specific manner. In this context, it is then also possible, on account of this orientation, for at least one wall, which delimits the handle recess, to be used to display information. This information representation can also be presented in a very easy and intuitively perceptible manner to a user, precisely because the handle recess is accessible from above.

Provision is preferably made for the bottom wall to end with a front edge on a lower edge of the front wall of the handle. As a result, a lowest point of the handle recess which is in effect toward the front and therefore faces a user positioned in front of the domestic appliance is produced in the front region. The gripping of the front wall and thus the safe actuation of the appliance component is enabled particularly advantageously as a result. An unwanted slipping of the front wall or suchlike is prevented as a result. Furthermore, on account of this specific arrangement the orientation of the slanted bottom wall is then also advantageous with respect then to the user, who is positioned in front of the domestic appliance, a slanted position facing said user being offered so that a corresponding presentation of information also already falls within the field of view of the user.

Provision is preferably made for the bottom wall to be arranged at an angle of between 25° and 65°, in particular of between 35° and 55°, with respect to the front wall of the handle. This is particularly advantageous to the extent that on the one hand the ergonomic ability to grip is favorable and the fingers do not run too closely against an excessively steep bottom wall if the front wall is gripped. On the other hand, on account of this specific orientation a presentation of information is also particularly advantageous since visual reflections or other mirror imaging can be reduced the most as a result. The ability to perceive correspondingly presented information is advantageous precisely with an inclined arrangement of the bottom wall of this type.

In an advantageous embodiment, provision is made for the front wall of the handle to be oriented at a right angle. As a result, viewed in the depth direction of the appliance component, a very compact embodiment of the handle is enabled and at the most a minimal projection forward, in particular absolutely no projection forward, is formed. As a result, the afore-cited advantages with respect to the maximum grippability and slip-safety are also improved.

Provision is preferably made for the bottom wall to have an electronic control and/or electronic display unit on the side facing the handle recess. As a result, a presentation of information and/or a control option is produced particularly advantageously. The bottom wall, precisely with its slanted positioning, thus enables a comprehensive representation of information which can be perceived easily, and also on the other hand enables control in a user-friendly and easily accessible manner, since on account of the corresponding orientation of the bottom wall, the interface and the control elements are in effect facing the user and the actuation can therefore be realised without a complex movement and therefore without unduly curving or bending a finger.

The accessibility for controlling these control elements in the handle recess is as a result also possible in a very ergonomic manner.

Provision is preferably made for the control unit to have touch-sensitive control elements. As a result, the design above the bottom wall is in effect not raised, since these touch-sensitive control regions are embodied with sensors arranged below. The installation space of the handle recess is not negatively affected as a result.

Provision is preferably made for the display unit to comprise a TFT display. As a result, dynamic information can be presented in addition to static information and the variety of colors and also the authenticity of the presentation of information is particularly high as a result. Furthermore, a very flat design of the display unit is also enabled as a result, which in turn also means that the handle recess is not restricted in terms of installation space.

Provision is preferably made for an upper end of the bottom wall to be arranged further to the top, viewed in the vertical direction of the appliance component, than an upper end of the front wall of the handle. This is to this effect a particularly advantageous embodiment, since viewed in the vertical direction the bottom wall projects further upward than the front wall despite its slanted position. On the one hand the accessibility to the handle recess is improved as a result, on the other hand, a presentation of information and then also in particular the perception of information is notably easier for a user. This is because the user does not firstly need to look completely behind the front wall, but can also identify information already presented visually at a flatter angle of view to the handle.

Provision is preferably made for the bottom wall to be formed from glass. It is easy to clean as a result. By means also of a very smooth low-friction surface in this regard, when a user engages in the handle recess using his/her fingers and touches the bottom wall, he/she may experience an unwanted sense of touch or unwanted friction on the finger or suchlike. The user friendliness is increased as a result. In particular, a very high quality and noteworthy impression is also imparted by means of the embodiment from glass so that an attractive appearance results. In particular, the optical presentation of information is benefited by means of the embodiment made from glass, in particular made from a transparent glass at least in regions. It is precisely then when optical signals are emitted through light sources that an adverse effect through the glass with respect to an intensity weakening and/or light distortion is minimized.

Provision is preferably made for the handle recess to be delimited in the direction of its width at opposite ends by boundary walls. These boundary walls are in particular triangular, which then preferably results if the front wall is oriented vertically and the bottom wall is arranged correspondingly slanted thereto. These lateral boundary walls do not project forward in the depth direction compared with the front wall so that a very compact design is realized here. By means of these boundary walls, this also means that a certain lateral protective wall is formed on the bottom wall precisely with optical representations of information so that no incident light negatively affects the ability to perceive the information presented optically.

Provision is preferably made for at least the front wall of the handle to be integrated into the appliance component. No assembly costs involving handle components are required on the one hand due to a one-piece embodiment of this type. On the other hand, a uniform and therefore also one-piece overall image is therefore presented precisely with a frontal view. With a frontal view, the handle can in effect therefore not be perceived at first glance, but the front wall of the handle is instead in effect perceived as belonging to the front wall of the appliance component.

Provision is preferably made for the bottom wall to be embodied as a separate part and in a plate-like manner. On account of an embodiment of this type, a handle can be designed to be versatile in terms of its optical appearance.

The plate-like embodiment enables a very simple geometry of the bottom wall, which can be produced easily and can also be assembled easily.

The bottom wall is advantageously introduced into the appliance component as a separate insert. As a result, as already above, an individual appearance of the handle can be generated. Different bottom walls can be used substantially as an insert. The structuring can also be provided individually and/or the coloring can be embodied individually. A high number of handle variants can thus be easily generated, by only the bottom wall being selected and introduced individually. As a result, different appliance types or appliance variants can also be considered.

In a further advantageous embodiment, provision is made for the appliance component to have a one-piece strip part or a one-piece basic component, which in particular covers the appliance component from above. The handle recess is embodied integrated into this basic component in terms of its shape. This means that the front wall of the handle recess is integrated therein. Provision is made in particular for the bottom wall to be separate from this one-piece basic component. In order to be able to arrange the bottom wall accordingly in the basic component, this basic component has in particular a slanted receiving bed, which is likewise integrated into this basic component. The slanted position of this receiving bed corresponds here already to the slanted position, desired below, of the bottom wall still to be introduced. Provision is then made in particular for the bottom wall embodied as an insert to be arranged countersunk in this receiving bed. The number of components in this embodiment with the one-piece basic component is reduced and the bottom wall can still be used individually as a variant part or replacement part. This bottom wall is also arranged in a stable and positionally secure manner in the receiving bed by means of the arrangement. A simple assembly is enabled on the one hand precisely by means of the countersunk positioning of his bottom wall in the receiving bed, on the other hand a stable fit of the bottom wall is reached and moreover the handle recess is not undesirably restricted in terms of its volume.

Provision is preferably made for the receiving bed to be embodied on a first longitudinal side, in particular on an upper longitudinal side, viewed in the vertical direction, and horizontal longitudinal side, viewed in the depth direction, an undercut or pocket, in which a first longitudinal edge of the insert arranged slanted with respect to a front side of the insert penetrates. The bottom wall in its assembled end position is therefore held securely in the receiving bed and an unwanted folding out of the bottom wall in the direction of the front wall is prevented. In particular, this insert is then also pressed against the bottom side of this receiving bed by means of this undercut.

Provision is preferably made for a resilient tongue, which is in particular also integrated in one piece in the basic component, to be embodied in addition to or instead on a second longitudinal side of the receiving bed. A spring element of this type is therefore present integrated onto a second longitudinal side which faces the front wall, by means of which the insert is held securely in its position and a particularly simple assembly is enabled on the other hand.

In the assembled end state of the insert in this receiving bed, provision is made for this resilient tongue to be arranged so as to press on a second longitudinal edge of the insert. By means of this spring element, the insert in the assembled state is therefore pressed in the direction of the undercut which is preferably present, so that it is also pressed in a particularly stable manner into this undercut with this arrangement of the first longitudinal edge which is embodied with a particularly accurate fit. In the assembled state of the insert in this receiving bed, provision is made here for this resilient tongue to be arranged in a prestressed and thus also deflected state so that the spring force resulting in the direction of the undercut functions accordingly.

Provision is advantageously made for the basic component to have at least one insertion slot for the insert on the side of the receiving bed facing the front wall. A resilient tongue is arranged in particular in this insertion slot. In the assembled state, the insert therefore penetrates this slot in regions and then attaches to the resilient tongue. This means that the insert does not rise upward unintentionally if the pressure of the spring element takes place slanted upward in the direction of the opposing undercut. On account of this insertion into the slot, the insert is therefore held in position parallel to the slanted bottom side of the receiving bed and as a result the force of the resilient tongue acting on the insert is directed such that the insert is pressed as linearly as possible in a direction of its plane in which it extends and the displacement and pressing into the undercut takes place in as linear a manner as possible.

Provision is advantageously made for the bottom wall of the handle to be arranged in a non-destructive, detachable manner on the appliance component. This is an advantageous embodiment in that with respect to the afore-cited options a user himself/herself is also able to carry out an individual configuration of the handle at any time in order to take into account the individual visual appearances desired.

Provision is preferably made for the front wall of the handle to be integrated in a front wall of the appliance component and for the front wall of the handle to be arranged flush with a front side of the front wall of the appliance component. A particularly compact design is achieved as a result, since there is in effect no forward protrusion of the handle compared with the front side of the appliance component.

In an advantageous embodiment, provision is made for the appliance component to be a drawer. The appliance component may also be a door, however.

In particular, the domestic appliance is a domestic refrigerator for accommodating food. It may be a refrigerator or a freezer or a fridge/freezer, for instance. Groceries, such as food or beverages, can be introduced in the said drawer. Information relating to the environmental conditions within the drawer such as for instance a temperature or an air humidity can then be indicated on the available control and/or display unit. Similarly, in addition to or instead of this, information relating to the quantity and/or the type of groceries stored can likewise be presented. In this context, information can be presented by means of letters or symbols or digits.

In the embodiment of the appliance component as a door, this can likewise be arranged to close a receiving space for food. The information cited by way of example can then also be displayed here.

Precisely with the advantageous embodiment with a control and/or display unit, this is then integrated in a space-saving manner into the handle itself or an element forming the handle, namely the bottom wall, which delimits the specific type of handle with respect to the handle recess.

The indications "top", "bottom", "front", "rear", "horizontal", "vertical", "depth direction", "width direction", "height direction" indicate the positions and orientations existing in the case of normal use and normal arrangement of the appliance and in the case of an observer standing in front of the appliance and looking in the direction of the appliance.

Further features of the invention emerge from the claims, the figures and the description of the figures. The features and feature combinations mentioned above in the description and the features and feature combinations mentioned below in the description of the figures and/or simply shown in the figures can be used not only in the combination specified in each instance but also in other combinations or alone without departing from the scope of the invention. Embodiments of the invention that are not specifically illustrated and explained in the figures but which emerge and can be generated as a result of separate feature combinations from the described embodiments should therefore also be considered to be comprised and disclosed. Explanations and combinations of features which therefore do not have all features of an originally formulated independent claim are also to be regarded as disclosed.

BRIEF DESCRIPTION OF THE SEVERAL VIEWS OF THE DRAWING

Exemplary embodiments of the invention are explained in greater detail below on the basis of schematic drawings, in which.

DESCRIPTION OF THE INVENTION

Figure 1:
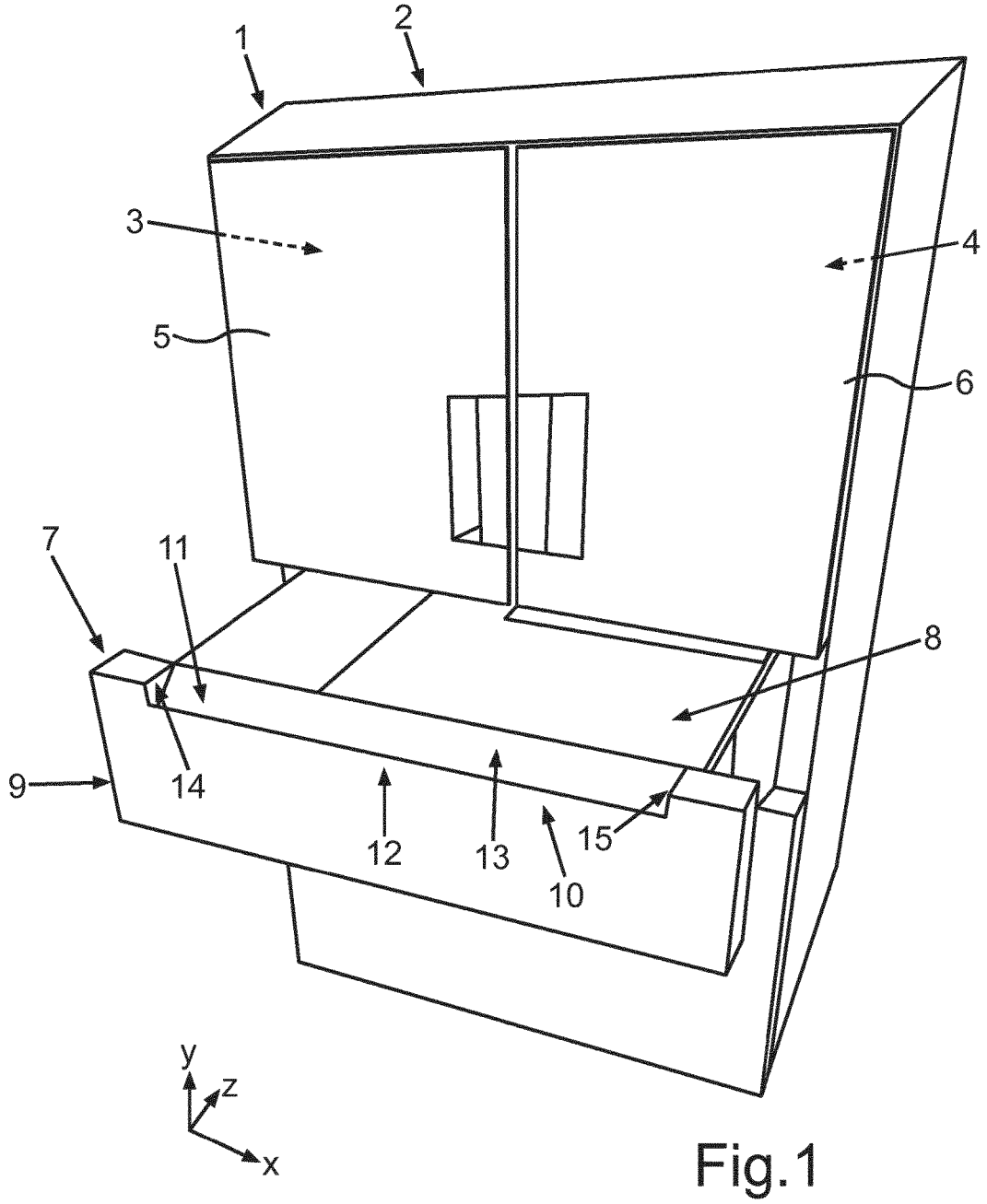
FIG. 1 shows a perspective view of an exemplary embodiment of an inventive household appliance.

In the drawings, the same or functionally identical elements are provided with the same reference characters.

FIG. 1 shows an exemplary embodiment of a domestic appliance 1, which here is in particular a domestic appliance for accommodating groceries.

The domestic appliance 1 comprises a housing 2, in which purely by way of example two separate receiving spaces 3 and 4 are formed for groceries. The receiving space 3 can be closed by a door 5 which is arranged pivotably on the housing 2. The receiving space 4 can be closed by a door 6 which is separate thereto and which is likewise arranged pivotably on the housing 2. In FIG. 1 the doors 5 and 6 are shown in the closed state.

Furthermore, in the exemplary embodiment the domestic appliance 1 comprises a drawer 7 embodied as an appliance component, which is shown in the pulled-out state. The drawer 7 can be moved relative to the housing 2 and is arranged on the housing 2. It can be moved linearly to and fro in the depth direction and thus in the z-direction. The drawer 7 comprises a receiving space 8, in which groceries can be introduced. The drawer 7 comprises a front wall 9 which delimits the front of the receiving space 8 and forms the front of the drawer 7 as an outer part. The front wall 9 has a handle 10. The handle 10 is incorporated into the front wall 9. The handle 10 comprises a handle recess 11 which can be gripped or engaged from above. The handle recess 11 is delimited by a front wall 12 of the handle 10 and a slanted bottom wall 13 of the handle 10. Furthermore, the handle recess 11, viewed in the width direction and thus in the x-direction, is delimited by two boundary walls 14 and 15 arranged at opposite ends of the handle recess 11 and thus also by the side arranged toward the bottom wall 13.

Figure 2:
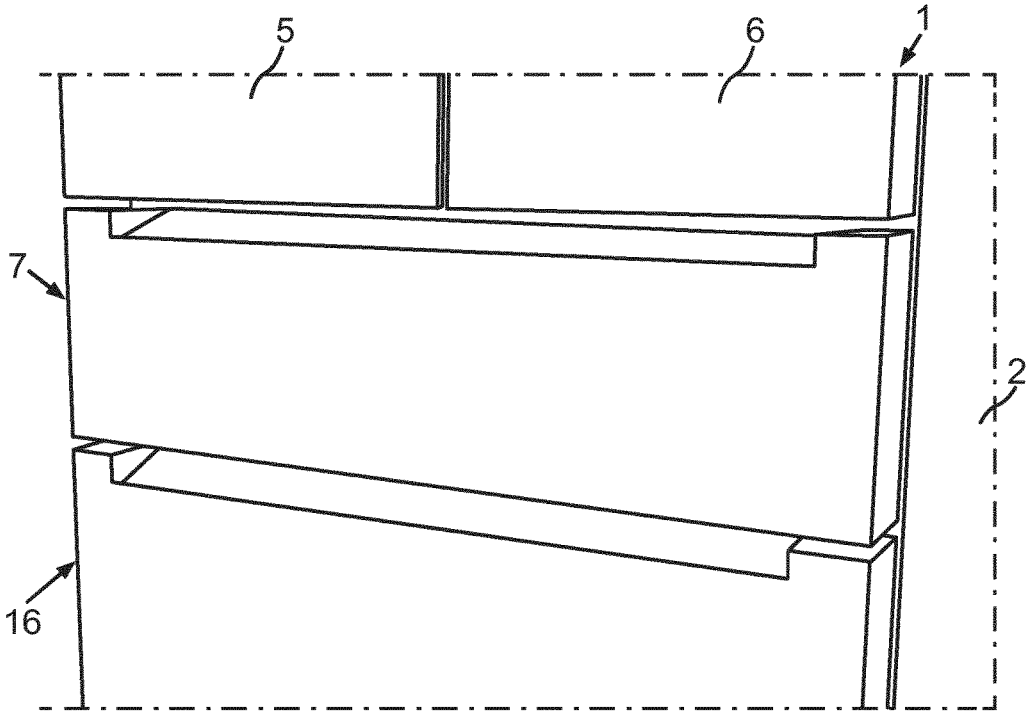
FIG. 2 shows a perspective view of a partial cutout of the domestic appliance according to FIG. 1, with the appliance component shown in FIG. 1 in the open state, which is closed in FIG. 2.

In FIG. 2 the drawer 7 is shown in the closed state.

It is also apparent there that in the exemplary embodiment the domestic appliance 1 has a further drawer 16 arranged therebelow, which likewise comprises a receiving space for groceries and by way of example is embodied in a similar manner to the drawer 7.

Figure 3:
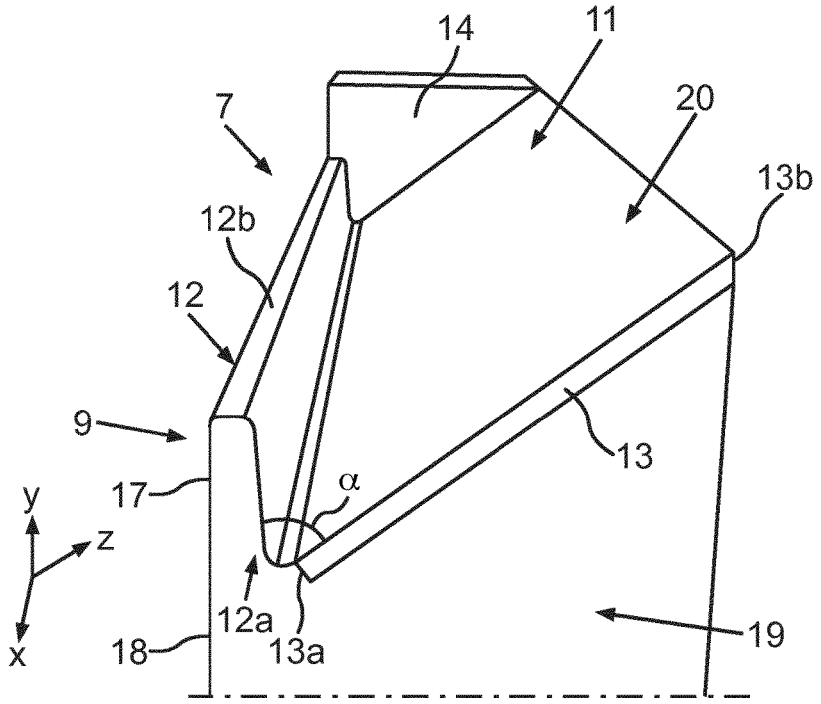
FIG. 3 shows a perspective sectional view through the appliance component according to FIG. 1 and FIG. 2.

In FIG. 3 the front wall 9 of the drawer 7 is shown in a perspective sectional view with a sectional plane which is located in the y-z plane. As is apparent, the front wall 12 of the handle 10 is oriented vertically and a front side 17, which faces away from the handle recess 11, is arranged flush with a front side 18 of the front wall 9. As is apparent, an angle $\alpha$ between the front wall 12 and the bottom wall 13 is between 25° and 65°, in particular between 30° and 50°.

As is also apparent, the bottom wall 13 ends with a front edge 13*a* on a lower edge 12*a* of the front wall 12. Furthermore it is apparent that in the vertical direction and thus in the y-direction an upper end 12*b* of the front wall 12 of the handle 10 is lower than an upper end 13*b* of the bottom wall 13.

The handle 10 can be embodied in one piece and integrated into the front wall 9. Provision can however also be made, as shown by way of example in FIG. 3, for the bottom wall 13 to be a separate component, and in particular embodied in a plate-like manner. It can then be inserted accordingly into the appliance component, and in this context glued for instance. As a result, an intermediate space 19, which is filled with a thermally insulating material, in particular an insulation foam, is also covered from above.

Provision can also be made for the bottom wall 13 to be embodied as a separate insert, and to be arranged in a non-destructive, detachable manner on the appliance component and thus the drawer 7. As a result, the bottom wall 13 can be replaced individually. A wide variety of bottom walls 13 can therefore be used, which then permit an individual visual appearance with respect to their coloring and/or with respect to their structuring.

In a particularly advantageous embodiment, provision is made for the handle 10 itself to have an electronic control and/or display unit 20. In particular, this electronic control and/or display unit 20 is embodied in the bottom wall 13. As a result, information can be presented and optically displayed by way of the bottom wall 13. In this context the control unit can have at least one touch-sensitive control element. The display unit can be a TFT display, for instance.

The bottom wall 13 is preferably made from glass.

Figure 4:
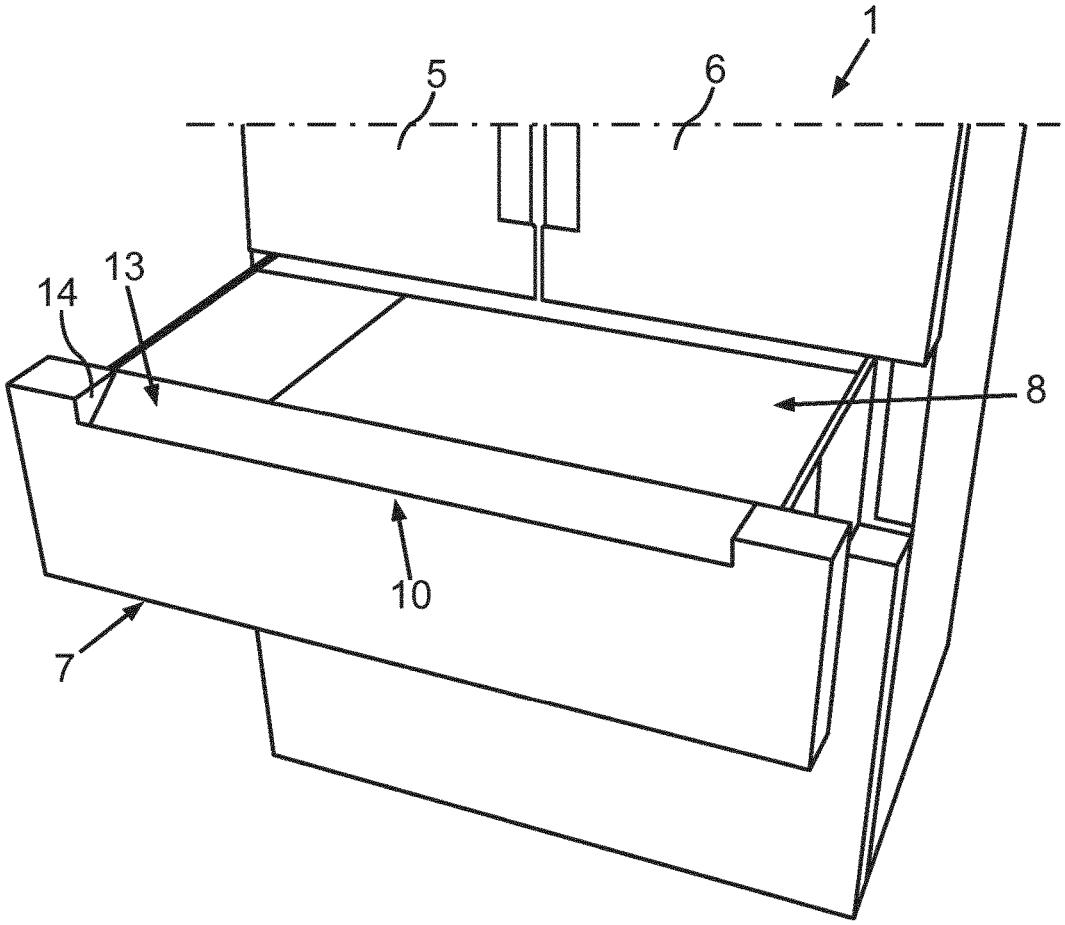
FIG. 4 shows a view of a partial cutout of the domestic appliance according to FIG. 1 with an embodiment of a handle which differs from FIG. 1.

FIG. 4 shows a further perspective view of a partial cutout of the domestic appliance 1 according to FIG. 1. Contrary to the view in FIG. 1, here the bottom wall 13 is designed differently and has a structuring and/or coloring which differ/s therefrom. The bottom wall 13 can be embodied here in particular as a non-destructive detachable insert and can thus be reversibly removed and subsequently inserted again. Metallic appearances or an appearance as a wood look can thus also be presented here. These are only examples, however, and are not to be understood as conclusive.

Figure 5:
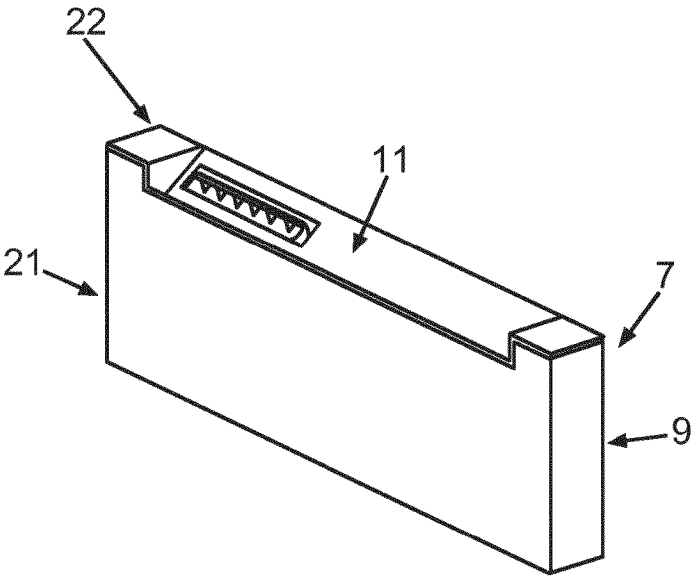
FIG. 5 shows a perspective view of a further exemplary embodiment of the appliance component.

FIG. 5 shows, in a perspective view, a further example in which the front wall 9 of the drawer 7 is shown. Here the front wall 9 comprises a main body 21, on the upper side of which a cover is arranged in the form of a strip part as a basic component 22. This basic component 22 is embodied in one piece and the handle recess 11 is integrated therein. This strip part represents an upper cover strip.

Figure 6:
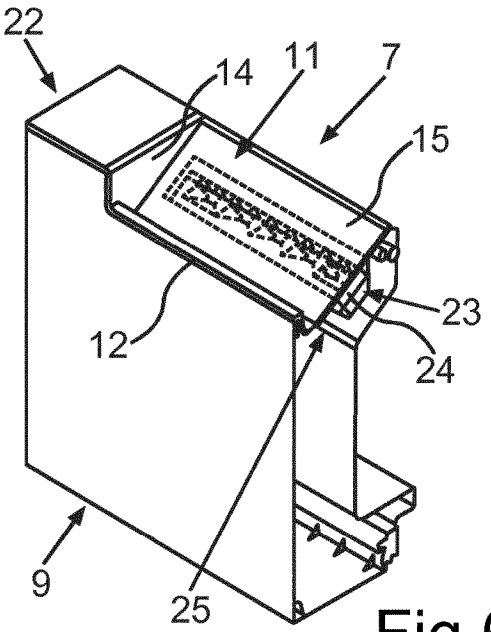
FIG. 6 shows a sectional view through the appliance components according to FIG. 5.

FIG. 6 shows a perspective sectional view of the embodiment according to FIG. 5. It is apparent here that this basic component 22 has the front wall 12 integrated therein. The boundary walls 14 and 15 are also embodied in one piece therewith. Furthermore, this basic component 22 comprises an integrated receiving space 23, in which an electronics unit 24 is arranged which is an integral part of the electronic control and/or display unit 20.

A receiving bed 25, which is embodied to receive the bottom wall 13 embodied as an insert, is likewise embodied integrated in the basic component 22. In FIG. 6 this insert is already arranged in its assembled end position.

Figure 7:
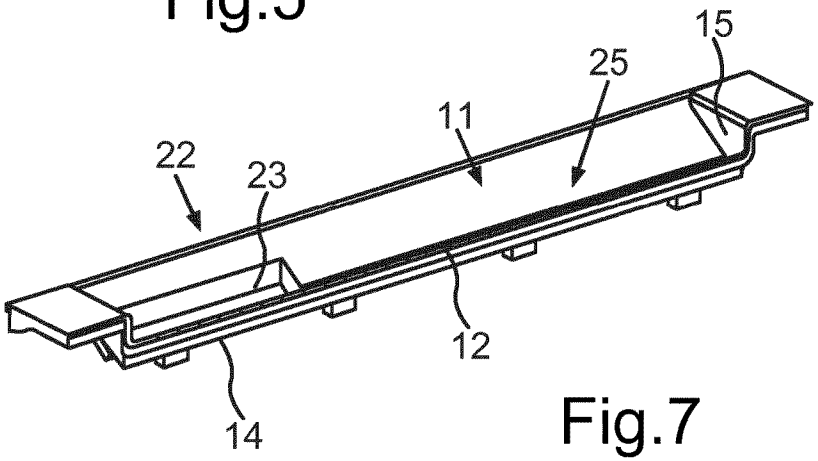
FIG. 7 shows a perspective view of an upper strip part of the appliance components according to FIGS. 5 and 6.

In FIG. 7 the basic component 22 is shown in a perspective view. Here the receiving bed 25 is oriented at a slant and is thus embodied in an arrangement with respect to the front wall 12, which is already provided for the position of the then plate-like bottom wall 13 which is embodied as an insert.

Figure 8:
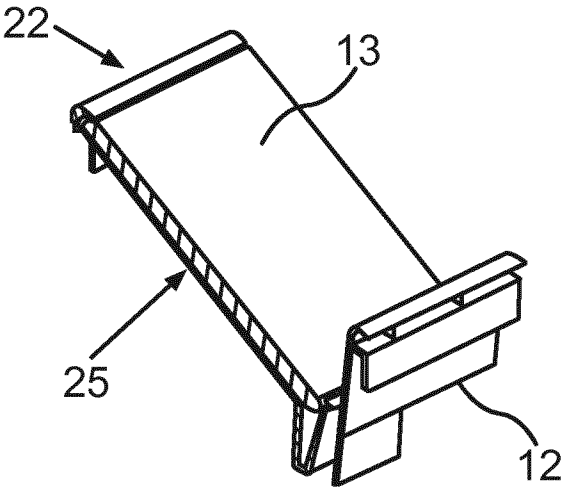
FIG. 8 shows a perspective sectional view of the strip part according to FIG. 7 with a bottom wall of a handle which is embodied as an insert.

In FIG. 8, the basic component 22 with the inserted bottom wall 13 is shown in a perspective sectional view.

Figure 9:
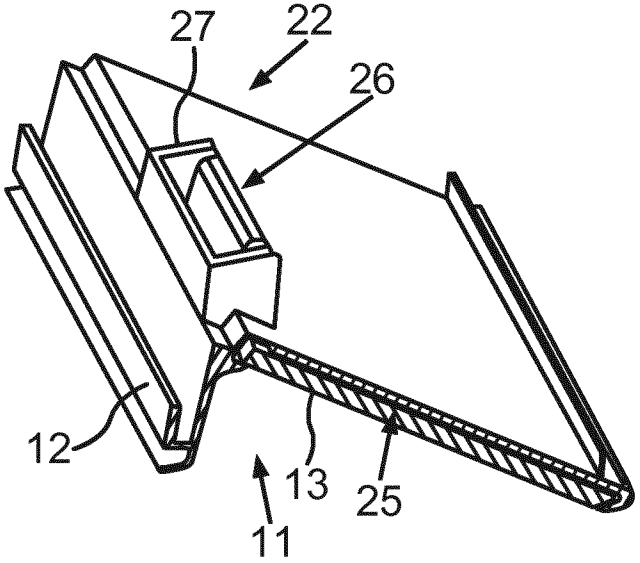
FIG. 9 shows the view according to FIG. 8 in a perspective view which differs therefrom.

In FIG. 9 the view in FIG. 8 is shown in a perspective view which differs thereto, namely viewed from below. It is apparent here that the basic component 22 has at least one resilient tongue 26 which is in one piece. This is arranged in a pocket 27.

Figure 10:
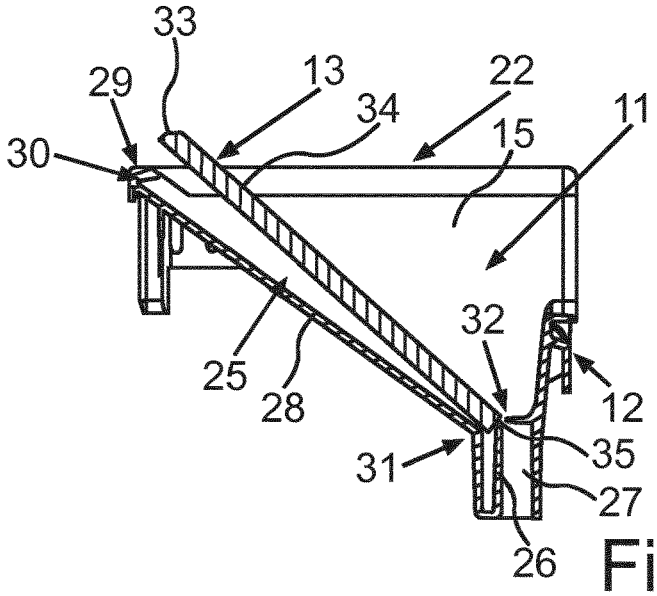
FIG. 10 shows a sectional view of the components according to FIGS. 8 and 9 in a first assembly step.
Figure 11:
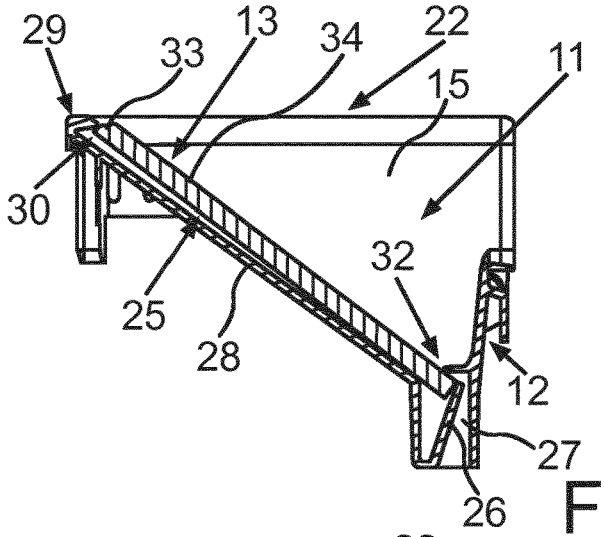
FIG. 11 shows a sectional view of the components according to FIGS. 8 and 9 in a second assembly step.
Figure 12:
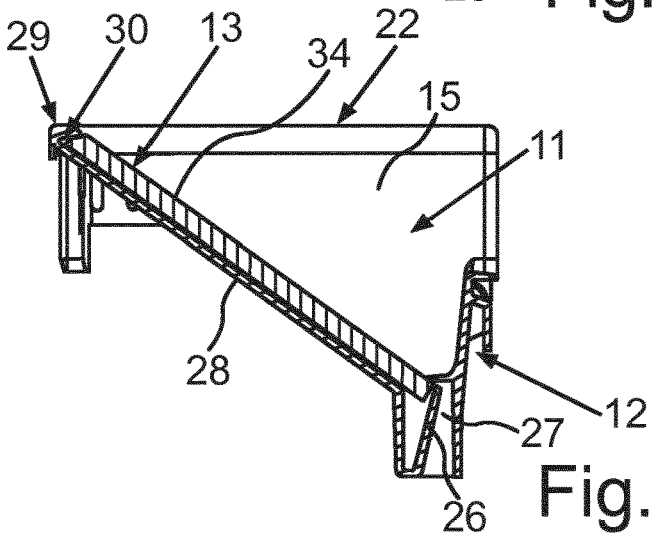
FIG. 12 shows a sectional view of the components according to FIGS. 8 and 9 in a third assembly step.

Reference is made to FIGS. 10 to 12 below with respect to the further function of the receiving bed 25 and the resilient tongue 26.

The basic component 22 is shown in a sectional view in FIG. 10, wherein here the bottom wall 13 is shown in a first assembly step. The receiving bed 25 can be seen here, which has a slanted bottom side 28. The receiving bed 25 moreover comprises an undercut 30 in a first longitudinal side 29 oriented in the width direction. This first longitudinal side 29 faces away from the front wall 12, and with respect to the slanted position of the receiving bed 25, represents the upper longitudinal side, viewed in the height direction, and the rear longitudinal side, viewed in the depth direction.

The already mentioned at least one resilient tongue 26 is arranged in the pocket 27 on a second longitudinal side 31, opposite this first longitudinal side 29, which faces the front wall 12. The pocket 27 has an insertion slot 32 on the side facing the first longitudinal side 29, through which the bottom wall 13 can be inserted in order to be able to contact the resilient tongue 26.

As is apparent, the bottom wall 13 has a first longitudinal edge 33 which is slanted compared with a front side 34. This slanted position is adjusted to the molding of the undercut 30 so that this first longitudinal edge 33 can penetrate the undercut 30 with a relatively good fit.

During assembly, in accordance with the view in FIG. 10, the bottom wall 13 is firstly inserted into the slot 32, as a result of which the resilient tongue 26 makes contact with a second longitudinal edge 35 and by means of the further insertion of the bottom wall 13 this resilient tongue 26 is bent back and pretensioned accordingly.

According to the view in FIG. 11, this is carried out until the first longitudinal edge 33 is able to be pushed into the undercut 30. This first longitudinal edge 33 is then pressed at most into the undercut 30 by means of the pretensioned resilient tongue 26 until the assembled end position is reached, which is shown in FIG. 12. In this assembled end position, the resilient tongue 26 is also pretensioned and thus deflected compared with the basic position shown in FIG. 10 in the direction of the front wall 12. As a result, the bottom wall 13 is pressed in the direction of the undercut 30 and the bottom wall 13 is held securely in the receiving bed 25.

LIST OF REFERENCE CHARACTERS

1 Domestic appliance
2 Housing

3 Receiving space
4 Receiving space
5 Door
6 Door
7 Drawer
8 Receiving space
9 Front wall
10 Handle
11 Handle recess
12 Front wall
12*a* Lower edge
12*b* Upper end
13 Bottom wall
13*a* Lower edge
13*b* Upper end
14 Boundary wall
15 Boundary wall
16 Drawer
17 Front side
18 Front side
19 Intermediate space
20 Electronic control and/or display unit
21 Main body
22 Basic component
23 Receiving space
24 Electronic unit
25 Receiving bed
26 Resilient tongue
27 Pocket
28 Bottom side
29 Longitudinal side
30 Undercut
31 Longitudinal side
32 Insertion slot
33 Longitudinal edge
34 Front side
35 Longitudinal edge

The invention claimed is:

1. A domestic appliance, comprising:

a housing;

an appliance component disposed on said housing being separate from said housing and being movable relative to said housing;

a handle disposed on said appliance component, said handle having a front wall and a slanted bottom wall, and said handle having a handle recess configured to be gripped from above, said handle recess being delimited by said front wall of said handle and said slanted bottom wall of said handle;

said bottom wall being a separate insert introduced into said appliance component; and said appliance component having a slanted receiving bed for receiving said insert, said receiving bed having at least one resilient tongue disposed so as to press on said insert upon said insert being assembled in an end state in said receiving bed.

2. The domestic appliance according to claim 1, wherein said front wall has a lower edge, and said bottom wall ends with a front edge on said lower edge of said front wall.

3. The domestic appliance according to claim 1, wherein said bottom wall is disposed at an angle between 25° and 65° relative to said front wall.

4. The domestic appliance according to claim 3, wherein said front wall is oriented at a right angle relative to said bottom wall.

5. The domestic appliance according to claim 1, wherein said bottom wall is disposed at an angle between 30° and 50° relative to said front wall.

6. The domestic appliance according to claim 5, wherein said front wall is oriented at a right angle relative to said bottom wall.

7. The domestic appliance according to claim 1, wherein said bottom wall has a side facing said handle recess, said bottom wall has at least one of an electronic control unit or an electronic display unit on said side facing said handle recess and information is displayed on said bottom wall.

8. The domestic appliance according to claim 7, wherein said electronic control unit has touch-sensitive control elements or said electronic display unit is a TFT display.

9. The domestic appliance according to claim 7, wherein said electronic control unit has touch-sensitive control elements and said electronic display unit is a TFT display.

10. The domestic appliance according to claim 1, wherein said bottom wall and said front wall of said handle each have a respective upper end, and said upper end of said bottom wall is disposed further up than said upper end of said front wall in a vertical direction of said appliance component.

11. The domestic appliance according to claim 1, wherein said bottom wall is made from glass.

12. The domestic appliance according to claim 1, wherein said handle recess has a width direction and opposite ends, and said handle recess is delimited in said width direction on said opposite ends by boundary walls.

13. The domestic appliance according to claim 12, wherein said boundary walls are triangular.

14. The domestic appliance according to claim 1, wherein at least said front wall of said handle is integrated into said appliance component.

15. The domestic appliance according to claim 1, wherein said bottom wall is disposed in a non-destructive, detachable manner on said appliance component.

16. The domestic appliance according to claim 1, wherein said appliance component includes a one-piece basic component in which said handle recess is integrated as a molding, and said basic component has a said slanted receiving bed into which said bottom wall is countersunk as said insert.

17. The domestic appliance according to claim 16, wherein:

said receiving bed has a first longitudinal side with an undercut;

said insert has a front side and a first longitudinal edge disposed at a slant relative to said front side and penetrating said undercut;

said insert has a second longitudinal edge; and said receiving bed has a second longitudinal side with said at least one resilient tongue.

18. The domestic appliance according to claim 16, wherein said receiving bed has a longitudinal side with an undercut, and said insert has a front side and first longitudinal edge disposed at a slant relative to said front side and penetrating said undercut.

19. The domestic appliance according to claim 16, wherein said insert has a longitudinal edge, and said receiving bed has a longitudinal side with said at least one resilient tongue.

20. The domestic appliance according to claim 1, wherein:

said appliance component has a front wall with a front side;

said front wall of said handle is integrated in said front wall of said appliance component; and said front wall of said handle has a front side disposed flush with said front side of said front wall of said appliance component.

21. The domestic appliance according to claim 1, wherein said appliance component is a drawer or a door.

22. A domestic appliance, comprising:

a housing;

an appliance component disposed on said housing being separate from said housing and being movable relative to said housing;

a handle disposed on said appliance component, said handle having a front wall and a slanted bottom wall, and said handle having a handle recess configured to be gripped from above, said handle recess being delimited by said front wall of said handle and said slanted bottom wall of said handle;

said bottom wall being a separate insert introduced into said appliance component, said insert having a slanted edge; and said appliance component having a slanted receiving bed for receiving said insert, said receiving bed having an undercut receiving said slanted edge.

* * * * *